US008760483B2

(12) United States Patent
Masuda

(10) Patent No.: US 8,760,483 B2
(45) Date of Patent: Jun. 24, 2014

(54) EXPOSURE DEVICE AND IMAGE FORMING APPARATUS INCLUDING SAME

(75) Inventor: Kensuke Masuda, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 118 days.

(21) Appl. No.: 12/869,166

(22) Filed: Aug. 26, 2010

(65) Prior Publication Data

US 2011/0050836 A1 Mar. 3, 2011

(30) Foreign Application Priority Data

Aug. 28, 2009 (JP) ..... 2009-197752

(51) Int. Cl.

| | |
|---|---|
| ***B41J 2/385*** | (2006.01) |
| ***B41J 2/39*** | (2006.01) |
| ***B41J 2/41*** | (2006.01) |
| ***B41J 2/45*** | (2006.01) |
| ***B41J 15/14*** | (2006.01) |
| ***B41J 2/435*** | (2006.01) |
| ***B41J 27/00*** | (2006.01) |

(52) U.S. Cl.

CPC .. *B41J 2/385* (2013.01); *B41J 2/41* (2013.01); *B41J 2/435* (2013.01); *B41J 2/45* (2013.01)

USPC ..... 347/238; 347/130; 347/137; 347/138; 347/141; 347/152; 347/242; 347/244; 347/245; 347/257; 347/258; 347/263

(58) Field of Classification Search

CPC ..... B41J 2/385; B41J 2/41; B41J 2/435; B41J 2/45; B41J 2/455; B41J 2/47

USPC ..... 347/111, 112, 129, 130, 134, 137, 138, 347/141, 152, 224, 225, 233, 238, 241, 242, 347/244, 245, 256, 257, 258, 263

See application file for complete search history.

(56) References Cited

U.S. PATENT DOCUMENTS 6,456,314 B1 9/2002 Masuda
7,042,591 B1 * 5/2006 Yamazaki et al. ..... 358/1.5

(Continued)

FOREIGN PATENT DOCUMENTS

CN 101339284 A 1/2009
JP 4-107268 9/1992

(Continued)

OTHER PUBLICATIONS

Combined Chinese Office Action and Search Report issued Mar. 26, 2013, in Chinese Patent Application No. 201010268130.5 with English translation of category of cited documents.

(Continued)

*Primary Examiner* — Alessandro Amari
*Assistant Examiner* — Kendrick Liu
(74) *Attorney, Agent, or Firm* — Oblon, Spivak, McClelland, Maier & Neustadt, L.L.P.

(57) ABSTRACT

In an exposure device, a light source device having multiple light emitting devices arranged in one-dimensional or two-dimensional directions projects light against an image bearing member. A light source holding member holds the light source device in place. An optical device condenses the light projected from the light source device onto the image bearing member. An optical device holding member holds the optical device to maintain a predetermined gap between the optical device and the light source device on the light source holding member. A positioning member supports the light source holding member above the image bearing member to maintain a predetermined gap between the image bearing member and the light source device on the light source holding member. When seen from a light emitting point of the light source device, a position at which the positioning member supports the light source holding member is opposite the image bearing member.

11 Claims, 6 Drawing Sheets

(56) References Cited

U.S. PATENT DOCUMENTS

| | | | | |
|---|---|---|---|---|
| 7,602,540 | B2 | 10/2009 | Masuda et al. | |
| 7,671,884 | B2 | 3/2010 | Itami et al. | |
| 2003/0222968 | A1* | 12/2003 | Nagamine | 347/245 |
| 2004/0056943 | A1* | 3/2004 | Oda et al. | 347/129 |
| 2008/0174843 | A1 | 7/2008 | Masuda et al. | |
| 2008/0212999 | A1 | 9/2008 | Masuda et al. | |
| 2008/0225399 | A1* | 9/2008 | Tsujino et al. | 359/619 |
| 2008/0292359 | A1* | 11/2008 | Yamaguchi | 399/177 |
| 2009/0009875 | A1* | 1/2009 | Nomura | 359/621 |
| 2009/0274488 | A1* | 11/2009 | Sugiyama | 399/217 |
| 2010/0020301 | A1* | 1/2010 | Sugiyama et al. | 355/67 |
| 2010/0091083 | A1 | 4/2010 | Itami et al. | |

FOREIGN PATENT DOCUMENTS

| | | | |
|---|---|---|---|
| JP | 10-69143 | | 3/1998 |
| JP | 10-119345 | | 5/1998 |
| JP | 2001-150715 | | 6/2001 |
| JP | 2003-66306 | | 3/2003 |
| JP | 2004-96088 | A | 3/2004 |
| JP | 2005-14497 | | 1/2005 |
| JP | 2008-134644 | A | 6/2008 |
| WO | WO 2008/146655 | A1 | 12/2008 |

OTHER PUBLICATIONS

Japanese Office Action issued Sep. 24, 2013, in Japan Patent Application No. 2009-197752.

Chinese Office Action issued Nov. 5, 2013 in Patent Application No. 201010268130.5 with English Translation of Category of Cited Documents.

* cited by examiner

FIG. 3A
RELATED ART
FIG. 3B
RELATED ART
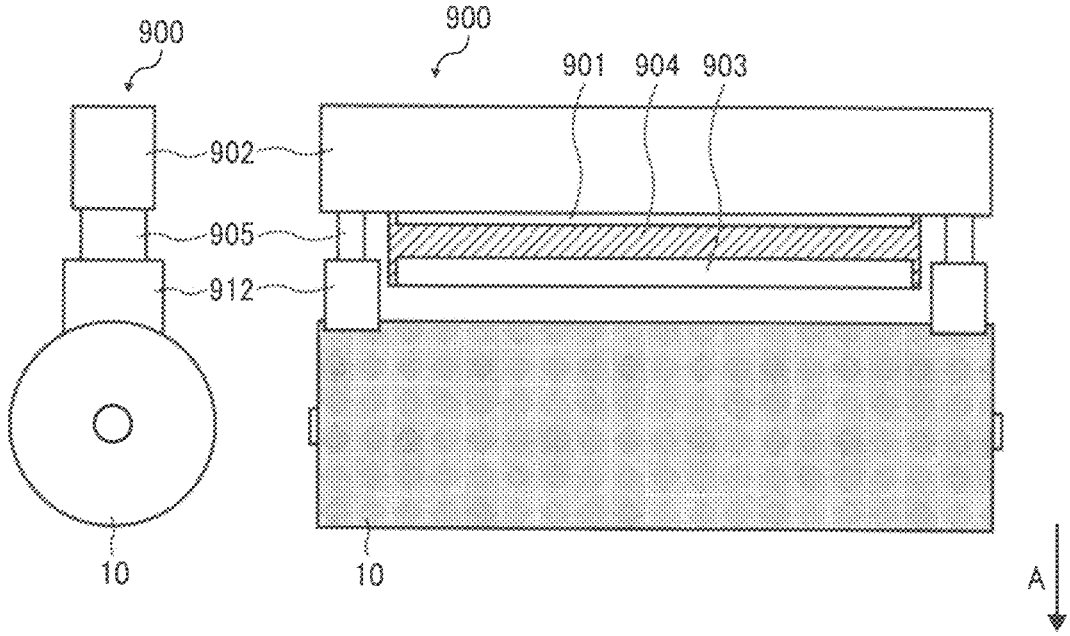
FIG. 4A
FIG. 4B
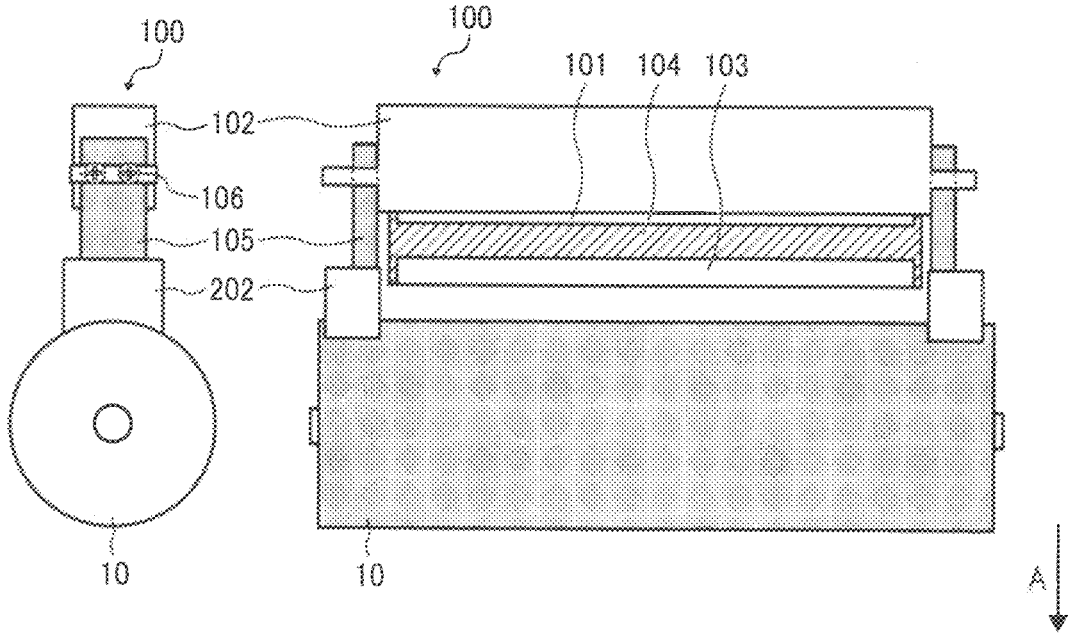

AT NORMAL TEMPERATURE

WHEN TEMPERATURE RISES

FIG. 7A
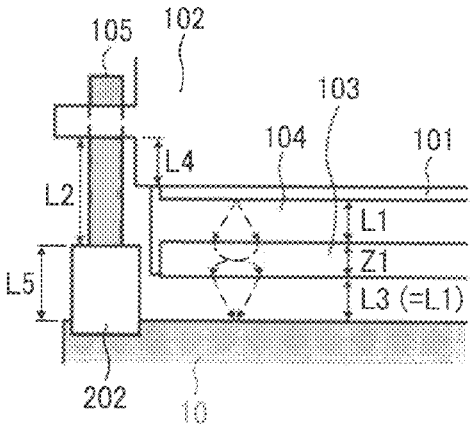
AT NORMAL TEMPERATURE
FIG. 7B
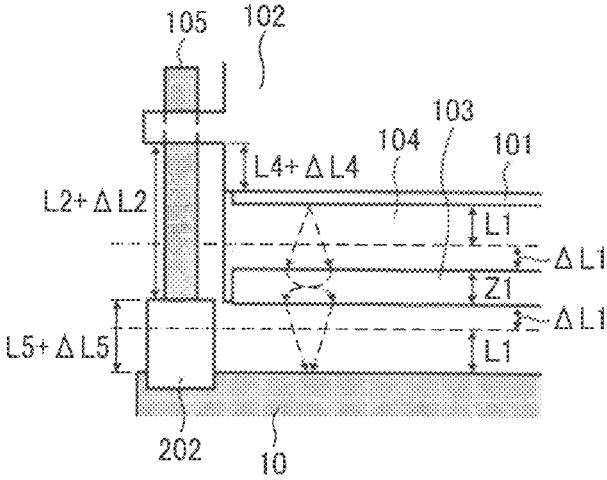
WHEN TEMPERATURE RISES
FIG. 8A
FIG. 8B
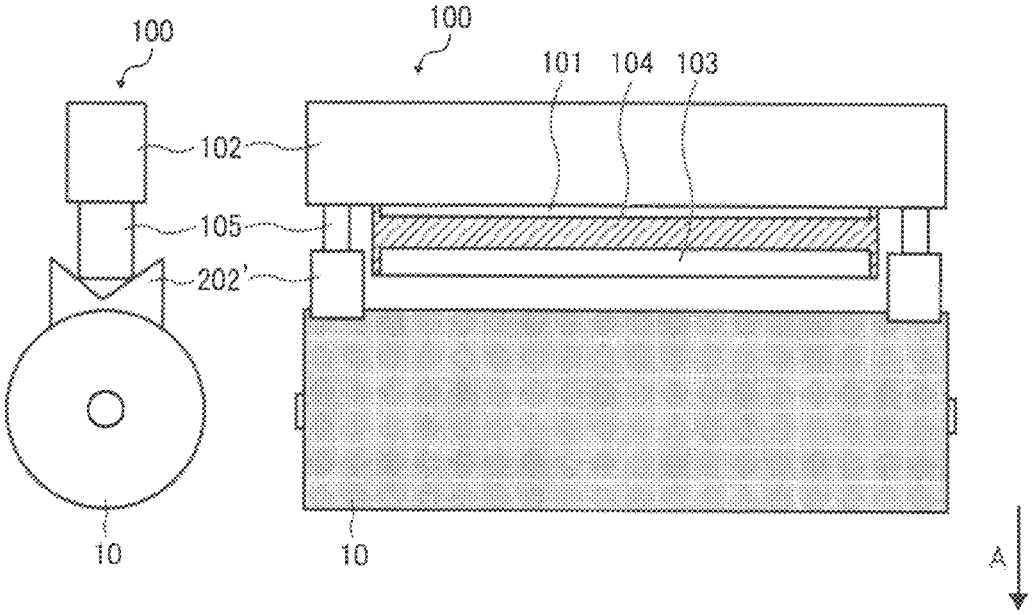

EXPOSURE DEVICE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application No. 2009-197752, filed on Aug. 28, 2009 in the Japan Patent Office, which is hereby incorporated herein by reference in its entirety.

BACKGROUND OF THE INVENTION

1. Field of the Invention

Exemplary aspects of the present invention generally relate to an exposure device, and more particularly, to an image forming apparatus using the exposure device, such as a digital copier, a laser printer, and a laser facsimile.

2. Description of the Background Art

Recent electrophotographic image forming apparatuses such as copiers, laser beam printers, and facsimile machines form an image by converting electronic information into optical information. Based on the optical information, an exposure device employed in the image forming apparatus projects light against a photoreceptor serving as an image bearing member to form a latent image thereon. Then, the latent image is developed with toner and the like, forming a visible image, also known as a toner image.

Two types of exposure devices are known in the art. One is an optical scanning device including a combination of a light source and a light deflector such as a polygon motor. The other is an array light source device having light emitting devices arrayed in a line so as to expose an entire surface of the photoreceptor in a scanning direction all at one time.

Of the two types of exposure devices described above, the array light source device is advantageous for various reasons, including 1) a smaller exposure device, thus resulting in reduction of the size of the image forming apparatus as a whole, 2) a narrower beam diameter on the surface of the photoreceptor, thus resulting in a higher-quality output image, and 3) longer product life of the exposure device, thus resulting in a longer lifespan for the apparatus.

Although advantageous, there is a drawback in the array light source device in that a depth of beam at a focal position is narrow. More specifically, although the optical scanning device has a depth of beam (a depth corresponding to ±10% of the minimum diameter of the beam) of approximately 5 mm, by contrast the depth of beam of the array light source device is as small as ±20 to 30 μm. This difference in the depth of the beam appears as a difference in a degree of tolerance of focus under environmental variations, for example variations in temperature.

In particular, the number of light emitting sources in the array light source device is approximately 10 E+2 to 10E+3 times more than those in the optical scanning device. Consequently, the array light source device releases more heat as the exposure device, causing thermal expansion (thermal deformation) in the light source device due to not only the variations in the temperature but also self-heating. Thermal expansion of the light source device due to heat causes fluctuation of a distance between the array light source and a focusing lens, increasing the beam diameter on the photoreceptor which causes displacement of the focal position. As a result, the quality of the image deteriorates.

To address this problem, Japanese Unexamined Patent Publication No. 2003-066306 (JP-2003-066306-A) proposes a method for correcting displacement of a focal position due to fluctuations in temperature in an exposure device. The method includes providing a temperature measuring device in an exposure device and a control device for adjusting the focal position according to a value measured by the temperature measuring device, and adjusts the focus according to fluctuation in the temperature.

Disadvantageously, however, the number of parts in the exposure device increases, thereby complicating efforts to make the image forming apparatus at low cost.

In view of the foregoing, a device capable of preventing deterioration of an image due to environmental changes while reducing the cost by reducing the number of parts is needed.

SUMMARY OF THE INVENTION

In view of the foregoing, in one illustrative embodiment of the present invention, an exposure device includes a light source device, a light source holding member, an optical device, an optical device holding member, and a positioning member. The light source device includes a plurality of light emitting devices arrayed in a one-dimensional or a two-dimensional array, to project light. The light source holding member holds the light source device in place. The optical device focuses the light projected from the light source device onto an image bearing member. The optical device holding member holds the optical device so as to maintain a predetermined gap between the optical device and the light source device on the light source holding member. The positioning member supports the light source holding member above the image bearing member so as to maintain a predetermined gap between the image bearing member and the light source device on the light source holding member. The position at which the positioning member supports the light source holding member is opposite the image bearing member when seen from the light projection point of the light source device.

In another illustrative embodiment of the present invention, an image forming apparatus includes an image bearing member, an exposure device, and a contact member. The image bearing member bears an electrostatic latent image on the surface thereof. The exposure device illuminates the image bearing member to form the electrostatic latent image on the surface of the image bearing member. The exposure device includes a light source device, a light source holding member, an optical device, an optical device holding member, and a positioning member. The light source device includes a plurality of light emitting devices arranged in a one-dimensional or a two-dimensional array, to project light. The light source holding member holds the light source device in place. The optical device focuses the light projected from the light source device onto the image bearing member. The optical device holding member holds the optical device so as to maintain a predetermined gap between the optical device and the light source device on the light source holding member. The positioning member supports the light source holding member above the image bearing member so as to maintain a predetermined gap between the image bearing member and the light source device on the light source holding member. The contact member is arranged continuously to the positioning member of the exposure device to contact the image bearing member and includes a groove that contacts a corner or an edge of a bottom surface side of the positioning member to support the positioning member of the exposure device. The groove gradually narrows toward the light source device.

Additional features and advantages of the present invention will be more fully apparent from the following detailed description of illustrative embodiments, the accompanying drawings and the associated claims.

BRIEF DESCRIPTION OF THE DRAWINGS

Various other objects, features and attendant advantages of the present invention will be more fully appreciated as the same becomes better understood from the detailed description when considered in connection with the accompanying drawing(s) in which like reference characters designate like corresponding parts throughout and wherein:

FIGS. 3A and 3B are schematic diagrams illustrating a related-art image forming apparatus;

FIGS. 4A and 4B are schematic diagrams illustrating an image forming apparatus according to a first illustrative embodiment of the present invention;

FIGS. 7A and 7B are schematic diagrams illustrating relative positions of the light emitting device array and a fixing portion of a light source holding member with a positioning member in the image forming apparatus according to an illustrative embodiment of the present invention;

FIGS. 8A and 8B are schematic diagrams illustrating the image forming apparatus according to a second illustrative embodiment of the present invention;

DETAILED DESCRIPTION OF ILLUSTRATIVE EMBODIMENTS

Figure 1:
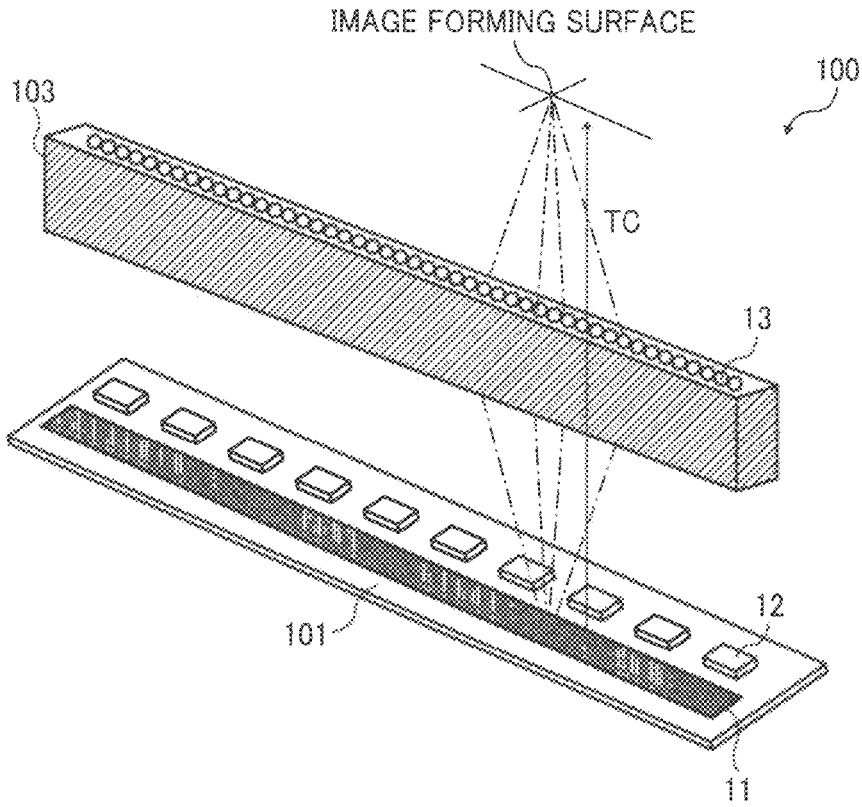
FIG. 1 is a schematic diagram illustrating a light emitting device array and an imaging device array in an exposure device according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural foams as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Figure 2:
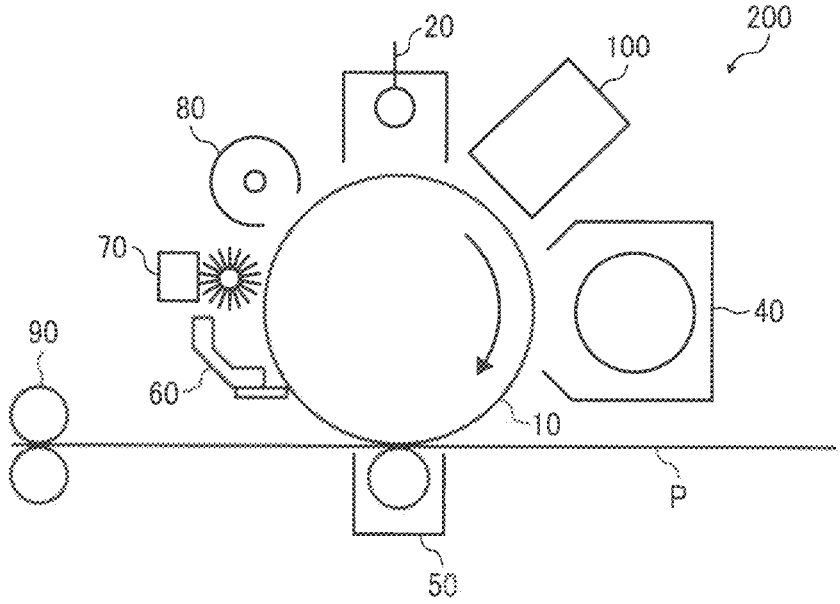
FIG. 2 is a schematic cross-sectional diagram illustrating an image forming apparatus according to the present invention.

Referring now to the drawings, a description will be provided of an example of an exposure device and an image forming apparatus of the present invention with reference to FIGS. 1 and 2.

FIG. 1 is a schematic diagram illustrating an exposure device 100 according to an illustrative embodiment of the present invention. FIG. 2 is a schematic cross sectional diagram illustrating the image forming apparatus which employs the exposure device 100 of the present invention.

The exposure device 100 includes a light emitting device array (LED array) 101 serving as a light source device, light emitting devices (LEDs) 11 constituting the light emitting device array (LED array) 101, a driver IC (driver) 12 for driving the light emitting devices (LEDs) 11, and an imaging device array 103. The imaging device array 103 is positioned with respect to the light emitting device array 101 as described below, and is held by a frame, that is, an optical device holding member 104, shown in FIG. 4.

The LED array 101 includes the plurality of light emitting devices 11 arranged in a one-dimensional or a two-dimensional array with a certain predetermined gap therebetween. Light emitted from the LEDs 11 of the LED array 101 form an image on the imaging device array 103, thus forming a light spot on a field (surface).

In general, the imaging device array 103 is a rod lens array including a plurality of gradient refractive index imaging devices (rod lenses) 13 bound together.

As illustrated in FIG. 1, the distance between the light emitting device array 101 and an image bearing member (photoreceptor) is set equal to a conjugation length TC of the rod lens 13, and the rod lens array is arranged in the center thereof. In this example, LEDs are used as the light emitting devices. However, other light emitting devices (such as organic EL) may also be used.

Referring now to FIG. 2, there is provided a schematic cross-sectional diagram illustrating the image forming apparatus according to the present invention.

An image forming unit in the image forming apparatus as shown in FIG. 2 includes a photoreceptor 10 serving as an image bearing member, a charging unit 20, an exposure device 100, a developing unit 40, a transfer unit 50, a cleaning unit 60, a photoreceptor protective layer forming unit 70, and a charge remover 80.

In general, the photoreceptor 10 is made of material that behaves as an insulator in the dark but is electrically conductive when illuminated with light. The photoreceptor 10 includes as its chief components a charge generating layer that generates an electrical charge when illuminated with light and a charge transport layer that transports the generated charge to the surface of the photoreceptor 10.

The photoreceptor 10 rotates at a certain speed in a given direction. As illustrated in FIG. 2, in the present embodiment the photoreceptor 10 rotates in a clockwise direction indicated by an arrow. The outer surface of the photoreceptor 10 is charged by the charging unit 20 disposed adjacent to the photoreceptor 10. The photoreceptor 10 maintains a certain level of charge until illuminated with light.

Subsequently, the exposure device 100 projects light according to image data onto the charged surface of the photoreceptor 10. On the portion of the photoreceptor 10 illuminated with light, a charge opposite the charge on the surface of the photoreceptor 10 is generated in the charge generating layer of the photoreceptor 10. Then, the generated charge is sent to the outer surface of the photoreceptor 10, and couples with the charge on the surface of the photoreceptor 10. As a result, charged portions and non-charged portions according to the image data are formed on the surface of the photoreceptor 10, thereby forming what is called an electrostatic latent image.

In order to adhere toner to the electrostatic latent image, the developing unit 40 generates a difference between the potential of the developing unit 40 and the potential in the portion to which the toner is to be adhered, and uses the generated potential difference to transfer charged toner onto the surface of the photoreceptor 10. The image formed with the toner attached to the surface of the photoreceptor 10 is called a toner image.

The transfer unit 50 transfers the toner image onto a surface of a recording sheet P conveyed to the proper position by conveyance rollers from a sheet cassette, not illustrated. When the recording sheet P is conveyed to the transfer unit 50, the transfer unit 50 transfers a toner image onto the recording sheet P by using the difference between the potential of the surface of the photoreceptor 10 and the potential of the recording sheet P in the same manner as described above to move the toner from the developing unit 40 to the photoreceptor 10.

The recording sheet P onto which the toner image is transferred is conveyed by the fixing unit 90 along a sheet conveying path, and the toner image is fixed onto the recording sheet P using heat, pressure, and the like, thus forming an image.

Meanwhile, the photoreceptor 10 having passed through the transfer unit 50 is further rotated, and the cleaning unit 60 cleans the toner that has not been transferred onto the recording sheet P. The photoreceptor protective layer forming unit 70 forms a protective layer by applying a lubricating agent onto the surface of the photoreceptor 10 from which the residual toner has been removed, thus protecting the surface of the photoreceptor 10 from abrasion during charging and cleaning. The lubricating agent is made of zinc stearate and the like. Thereafter, the charge remover 80 once arranges the charge on the surface of the photoreceptor 10, and thereafter, the charging unit 20 applies a certain level of charge to the photoreceptor 10 again. In the electrophotography, the above steps are repeated to form an image.

In order to facilitate an understanding of the related art and of the novel features of the present invention, a description is now provided of a related-art exposure device with reference to FIGS. 3A and 3B.

FIGS. 3A and 3B are schematic diagrams illustrating an image forming apparatus including the related-art exposure device 900. FIG. 3A is a side view, and FIG. 3B is a front view. A direction of light projection from the light source is indicated by arrow A.

In the exposure device 900, a light emitting device array 901 and an imaging device array 903 are supported on a light source holding member 902 and an optical device holding member 904, respectively, with the optical device holding member 904 fixed on the light source holding member 902. Positioning members 905 and contact members 912 are arranged next to each other between the light emitting device array 901 and a photoreceptor 10. The positioning members 905 are provided at both end portions of the principal surface of the light source holding member 902 facing the photoreceptor 10, in a longitudinal direction thereof (i.e., a direction perpendicular to a direction in which a light beam is emitted from the light source, that is, the main scanning direction).

The contact members 912 are provided to contact both end portions of the photoreceptor 10, in the longitudinal direction thereof. The positioning members 905 and the contact members 912 adjust the distance between the light emitting device array 901 and the photoreceptor 10.

In this configuration, in general, the light source holding member 902 is made of an aluminum material in view of heat radiation property. When the light emitting device array 901 is activated, or the temperature in the exposure device 900 changes, heat is conducted to the light source holding member 902 having high thermal conductivity, and the optical device holding members 904 and the positioning members 905 are heated. When the optical device holding member 904 is heated, the optical device holding member 904 expands due to heat, which increases the distance between the light emitting device array 901 and the imaging device array 903. As a result, the focus of the beam is displaced on the photoreceptor 10. More specifically, when the temperature rises to 40° C., the focus is found to be displaced by 26 μm in the exposure device 900, but the positioning member 905 expands by about 3 μm. As a result, on the surface of the photoreceptor 10, the focus is displaced by 26 μm−3 μm=23 μm with respect to the initial state, and the beam diameter expands causing degradation of the image quality.

It is to be noted that in this example, the rise in the temperature refers to a rise in the temperature of the atmosphere in the exposure device due to a change in the environmental temperature and activation of the light emitting device array 901.

To address this problem, two methods are considered as described below, and the present invention is made based on these methods: 1) the amount of thermal expansion of the positioning member 905 (in the direction in which a light beam is emitted from the light source) is set greater than the amount of thermal expansion of the optical device holding member 904; and 2) The amount of variation (in the direction in which a light beam is emitted from the light source) of the positioning members 905 is set greater than the amount of thermal expansion of the optical device holding member 904 by effectively making use of a thermal expansion of the positioning member 905 in a direction perpendicular to the direction in which a light beam is emitted from the light source.

FIGS. 4A through 6B illustrate an exposure device 100 and an image forming apparatus 200 according to a first embodiment of the present invention. FIGS. 4A and 4B are schematic diagrams illustrating the image forming apparatus of the first embodiment of the image forming apparatus having the exposure device 100 according to the present invention. FIG. 4A is a side view, and FIG. 4B is a front view.

As shown in FIGS. 4A and 4B, in the exposure device 100, the light emitting device array 101 is held by a light source holding member 102. The imaging device array 103 serving as an imaging lens array (rod lens array) is held by the optical device holding member 104. The optical device holding member 104 is fixed to the light source holding member 102. With this configuration, the light emitting device array 101 and the imaging device array 103 are held and spaced apart a certain distance defined by the optical device holding member 104 on the light source holding member 102.

Positioning members 105 and contact members 202 are arranged next to each other between the light emitting device array 101 and the photoreceptor 10. Each of the positioning members 105 is fixed on both side surfaces of the light source holding member 102 in the longitudinal direction thereof (i.e., the direction perpendicular to the direction in which a light beam is emitted from the light source, that is, the main scanning direction). Each of the contact members 202 is provided so as to contact both end portions of the photoreceptor 10 in the longitudinal direction thereof The positioning members 105 and the contact members 202 adjust the distance between the light emitting device array 101 and the photoreceptor 10. Further, after the distance between the positioning member 105 and the photoreceptor 10 is adjusted, the positioning member 105 is fixed to the light source holding member 102 with screws 106, thereby supporting the light source holding member 102 on the photoreceptor 10 at this position.

Accordingly, the light emitting device array 101 is arranged such that the longitudinal direction of the light emitting device array 101, which is a direction in which the light emitting devices are arranged, is aligned with the longitudinal direction of the photoreceptor 10, and the surface from which a light beam is emitted is parallel to the surface of the photoreceptor 10 with a certain distance therebetween.

In this case, when the direction in which a light beam is emitted from the light source is denoted as "+", the position at which the positioning member 105 is fixed to the light source holding member 102 is located at "−" side (i.e., the side opposite the photoreceptor 10) with respect to the light emitting position of the light emitting device array 101.

With this configuration, the length of the positioning member 105 in the direction of light projection can be made longer than that of the related-art example (the positioning member 905 of FIG. 3), and accordingly, the amount of thermal expansion due to a temperature rise increases. In other words, the distance between the imaging device array 103 and the surface of the photoreceptor 10 increases according to the displacement of the focus caused by a temperature rise. Therefore, the displacement of the focus can be corrected without increasing the number of component parts.

However, in order to effectively use the thermal expansion of the positioning member 105 as a focus correction mechanism of the exposure device 100, the thermal expansion of the positioning member 105 needs to be greater than the thermal expansion of the light source holding member 102. More specifically, where a linear expansion coefficient of the light source holding member 102 is k1 and a linear expansion coefficient of the positioning member 105 is k2, it is necessary to satisfy the relation $k1<k2$.

Because the linear expansion coefficient of the positioning member 105 is greater that that of the light source holding member 102 ($k1<k2$), and the thermal expansion of the positioning member 105 is greater than that of the light source holding member 102, the positional displacement of the focus caused by environmental variations and heat generated by the exposure device itself can be cancelled out when the light emitting device array 101 is activated, thus reducing, if not preventing entirely, deterioration of images.

Further, the amount of thermal expansion of the positioning member 105 (in the direction of the light projection from the light source) can be made greater than the amount of thermal expansion of the optical device holding member 104 by 1) making the length of the positioning member 105 greater than the distance between the light emitting device array 101 and the rod lens array (imaging device array 103); and 2) selecting the positioning member 105 having a linear expansion coefficient greater than the optical device holding member 104.

Figure 5:
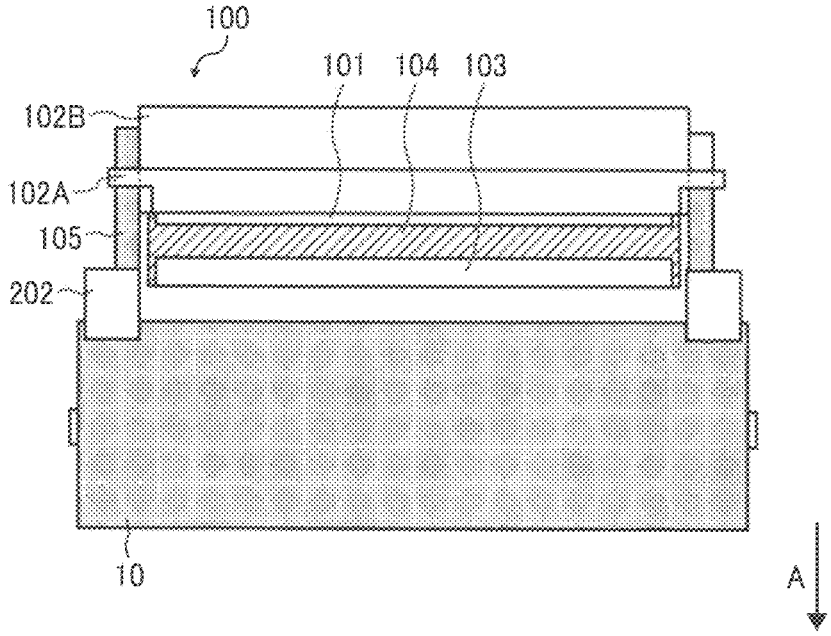
FIG. 5 is a schematic diagram illustrating a variation of the first embodiment of the image forming apparatus according to an illustrative embodiment of the present invention.

More specifically, as illustrated in FIG. 5, where L2 represents a distance between the position at which the positioning member 105 is in contact with the light source holding member 102 (the position fixed with the screw 106) and a top of the contact member 202, and L1 represents a distance between the surface of the light emitting device array 101 from which the light beam is projected and the incident plane of the imaging device array 103, it is preferable to satisfy $L2>L1$.

Alternatively, where the linear expansion coefficient of the positioning member 105 is k2 and a linear expansion coefficient of the optical device holding member 104 is k3, it is preferable to satisfy the relation $k2\geq k3$. Accordingly, the amount of thermal expansion of the positioning member 105 is made the same as the amount of positional displacement of the focus due to the amount of thermal expansion of the imaging device array 103. Thus, the exposure device 100 can maintain the focus on the image bearing member in spite of environmental variations and heat generated by the exposure device itself when the light emitting device array 101 is activated, thus reducing, if not preventing entirely deterioration of images.

As illustrated in FIG. 5, in a case in which the light source holding member 102 is constituted by a plurality of parts (102A, 102B), it is desirable to fix the positioning member 105 by a screw, not illustrated, to the light source holding part 102A for holding the light emitting device array 101, so that the part 102A is directly supported by the positioning member 105, and the photoreceptor 10 is positioned in place.

With this structure, even when the light source holding part 102B deforms due to stress or the like, the photoreceptor 10 is directly positioned by the positioning member 105 with respect to the light source holding part 102A on which the light emitting device array 101 is positioned in place. Therefore, the focus can be adjusted in response to thermal deformation.

In this configuration, material constituting the light source holding member 102 preferably includes, but is not limited to, metal having high thermal conductivity such as aluminum. Accordingly, the temperature of a portion in which the light source holding member 102 and the light emitting device array 101 contact each other and the temperature of a portion in which the light source holding member 102 and the positioning member 105 contact each other can be made uniform.

Uniform temperatures allow the positioning member 105 and the optical device holding member 104 to have a desired amount of thermal expansion, which makes this structure effective.

Figure 6A:
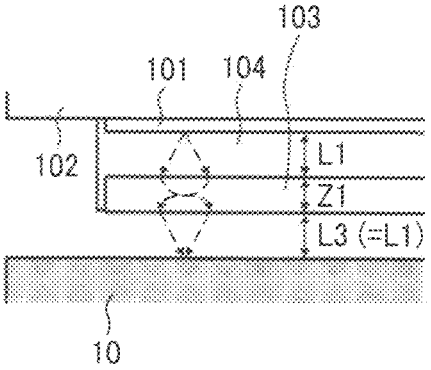
FIGS. 6A and 6B are schematic diagrams illustrating relative positions of the light emitting device array, the imaging device array, and a photoreceptor when the image forming apparatus according to the present invention is at a normal temperature and when the temperature rises, respectively.
Figure 6B:
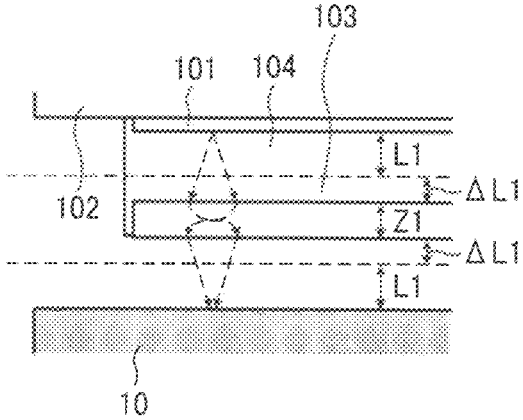

Referring now to FIGS. 6A and 6B, a description is now provided of relative positions of the light emitting device array 101, the imaging device array 103, and the photoreceptor 10, when the image forming apparatus is at a normal temperature and when the temperature rises. FIG. 6A illustrates relative positions at a normal temperature. FIG. 6B illustrates relative positions when the temperature rises.

In FIGS. 6A and 6B, L1 represents the distance between the surface of the light emitting device array 101 from which light is projected and the surface of the imaging device array 103 upon which the light beam incidents, Z1 represents the thickness of the imaging device array 103, and L3 represents the distance between the surface of the imaging device array 103 from which the light beam is projected and the surface of the photoreceptor 10. In the present embodiment, the imaging device array 103 forms an equal-magnification erect image. Therefore, L1 equals L3 (L1=L3).

When the temperature rises, the optical device holding member 104 expands due to heat. In a case where the distance between the light emitting device array 101 and the imaging device array 103 increases by ΔL1, the focal position also moves away by ΔL1 in the direction of light projection from the light source because the equal-magnification erect-imaging lens is employed.

In other words, when the imaging device array 103 moves by ΔL1 in the direction of light projection from the light source, the focal position of the exposure device 100 moves by 2ΔL1 (shown in FIG. 6B) from the initial state (shown in FIG. 6A).

Further, in the present embodiment, as illustrated in FIG. 7, the positional relations between the light emitting device array 101 and the fixing portion of the light source holding member 102 with the positioning member 105 differ in the direction of light projection from the light source.

When the temperature rises, the amount of thermal expansion of an installation distance L4 between the light emitting device array 101 and the fixing portion of the light source holding member 102 with the positioning member 105 need to be taken into consideration as a positional displacement of the focus. In other words, a sum of the amount of thermal expansion of the positioning member 105 and the amount of thermal expansion of the contact member 202 (ΔL2+ΔL5) should be equal to a sum of the amount of positional displacement of the focus caused by thermal variation of the above-described exposure device 100 (2ΔL1) and the amount of thermal expansion (ΔL4) of the difference (L4) between the installation surfaces of the two members (the light emitting device array 101 and the positioning member 105) of the light source holding member 102 (FIG. 7).

More specifically, the following equation (1) should be satisfied:

$$L2\cdot k2+L5\cdot k4=2L1\cdot k3+L4\cdot k1 \quad (1),$$

where k1 represents a linear expansion coefficient of the light source holding member 102, k2 represents a linear expansion coefficient of the positioning member 105, k3 represents a linear expansion coefficient of the optical device holding member 104, k4 represents a linear expansion coefficient of the contact member 202, L2 represents a distance between the fixing position of the light source holding member 102 with the positioning member 105 and a top of the contact member 202, L4 represents an installation distance between the fixing portion of the light source holding member 102 with the positioning member 105 and the light emitting device array 101, and L5 represents a distance between the position at which the contact member 202 contacts the positioning member 105 and the position at which the contact member 202 contacts the photoreceptor 10.

In the equation (1), in order to correct the amount of positional displacement of the focus when the temperature rises, the left side of the equation (1) should be made greater. That is, the amount of thermal expansion of the positioning member 105 or the amount of thermal expansion of the contact member 202 should be made larger.

However, it is desirable that the contact member 202 be made of material which deforms little (i.e., material having a small linear expansion coefficient and a small Young's modulus) under environmental changes (temperature, stress) in view of sliding property, abrasion property, and thermal deformation property with respect to the photoreceptor 10. Therefore, by selecting material having a relatively larger linear expansion coefficient than that of the contact member 202 as the positioning member 105, both a focus correction mechanism using thermal variation and a long lifespan of the contact member 202 can be achieved at the same time.

More specifically, it is preferable to satisfy the relationship of k2>k4, where k4 is the linear expansion coefficient of the contact member 202, and k2 is the linear expansion coefficient of the positioning member 105.

According to the present embodiment, the light source holding member 102 is made of aluminum (k1=$2.4\times10^{-5}$/° C.), the optical device holding member 104 is made of a PC (polycarbonate) material (k3=$6\times10^{-5}$/° C.), the positioning member 105 is made of a PC material (k2=$7\times10^{-5}$/° C.) that is different from the optical device holding member 104, and the contact member 202 is made of a PPS (polyphenylene sulfide resin) material (k=$1.0\times10^{-5}$/° C.).

The distance L1 between the light emitting device array 101 and the imaging device array 103 is approximately 3.0 mm. The thickness of the light emitting device array 101 is approximately 0.1 mm. The thickness Z1 of the imaging device array 103 is approximately 4.0 mm. The thickness of the contact member 202 is approximately 6 mm. The distance L2 between the fixing position of the light source holding member 102 with the positioning member 105 and a top of the contact member 202 is 4.38 mm. The distance L4 between the fixing portion of the light source holding member 102 with the light emitting device array 101 and the fixing portion of the light source holding member 102 with the positioning member 105 is 0.28 mm.

In this particular embodiment, the sum of the amount of positional displacement of the focus when the temperature rises to 40° C. and the thermal expansion of the distance between the light emitting device array 101 of the light source holding member 102 and the positioning member 105 is 2×3 mm×$6\times10^{-5}$/° C.×40° C.+0.28 mm×$2.4\times10^{-5}$/° C.×40° C.=14.7 μm. On the other hand, the amount of thermal expansion of the positioning member 105 and the contact member 202 is 4.38 mm×$7\times10^{-5}$/° C.×40° C.+6 mm×$1\times10^{-5}$/° C.×40° C.=14.7 μm.

Accordingly, the positional displacement of the focus can be absorbed by the thermal expansion of the positioning member.

Referring now to FIGS. 8 through 11, a description will be provided of a second illustrative embodiment of the preset invention.

FIGS. 8A and 8B are schematic diagrams illustrating the exposure device 100 according to the second illustrative embodiment of the present invention. FIG. 8A is a side view, and FIG. 8B is a front view.

As shown in FIG. 8B, when the positioning member 105 is arranged at the same position or at the "+" side (the photoreceptor 10 side) with respect to the light emitting device array 101 in the direction of light projection from the light source in the same manner as illustrated in FIG. 3, the shape of the contact member 202 is changed as shown in FIG. 8A, so that the focus can be adjusted by thermal expansion.

In other words, when a contact member 202' is seen from the side of a rotating shaft (the side of the side surface of the photoreceptor 10) of the photoreceptor 10 (FIG. 8A), the contact member 202' has a V-shaped groove. An angle between the inclined surfaces forming the V-shape is preferably 120 degrees.

Figure 9A:
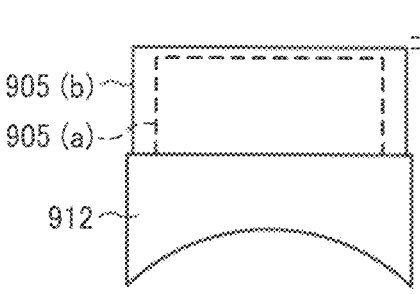
FIGS. 9A and 9B are schematic side views illustrating relative positions of the positioning member and a contact member when the temperature rises and thermal expansion occurs.
Figure 9B:
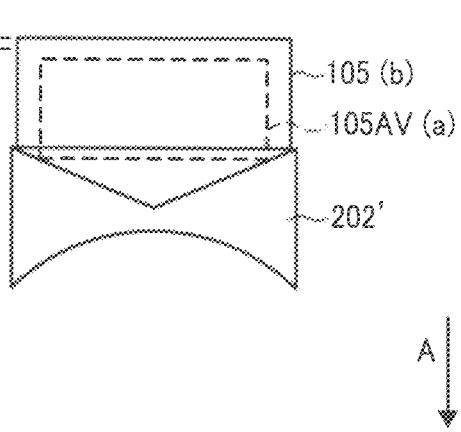

FIG. 9A and FIG. 9B illustrate the state of the positioning member 105 when the temperature rises and thermal expansion occurs. FIG. 9A illustrates the related-art contact member 912 (the structure shown in FIG. 3). FIG. 9B illustrates the contact member 202' according to the present embodiment the structure of FIG. 8). In FIG. 9A, 905(*a*) denotes the positioning member at a normal temperature, and 905(*b*) denotes the state of the positioning member when the temperature rises. In FIG. 9B, 105(*a*) denotes the state of the positioning member at a normal temperature, and 105(*b*) denotes the state of the positioning member when the temperature rises.

Consider a case where a heat of 40° C. is applied to the positioning members 105 and 905 made of a PC material (whose linear expansion coefficient is $7\times10^{-5}$/° C.) having a dimension of 4 mm long, 18 mm wide, and 4 mm high.

First, the height of the related-art positioning member 905 shown in FIG. 9A moves upward by 4 mm$\times7\times10^{-5}$/° C.$\times$40° C.=11.2 μm.

By contrast, the height of the positioning member 105 according to the illustrative embodiment shown in FIG. 9B moves upward by a sum of the increment of height position of the positioning member 105 in the height direction and the distance for which the positioning member 105 moves on the V-shaped groove of the contact member 202' due to thermal expansion in the width direction. Accordingly, the height of the positioning member 105 moves upward by 4 mm$\times7\times10^{-5}$/° C.$\times$40° C.+18 mm$\times7\times10^{-5}$/° C.$\times$40° C.$\times$tan(30°)/2=26 μm. That is, a sum ($\Delta L2+\Delta L5$) of the amount of thermal expansion of the positioning member 105 and the amount of thermal expansion of the contact member 202' increases, thus increasing the distance between the exposure device and the photoreceptor 10.

With this configuration, the focal displacement of approximately 26 μm in the above-described related-art exposure device 900 can be corrected by the increment of the height position of the positioning member 105.

Figure 10:
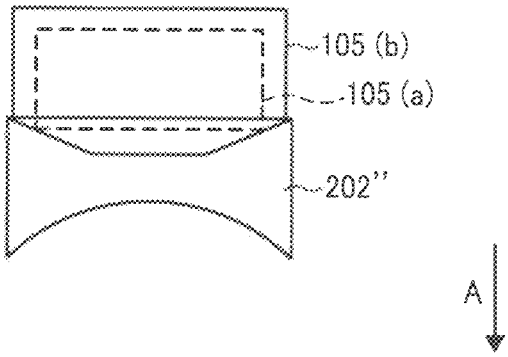
FIG. 10 is a schematic side view illustrating an example of relative positions of the positioning member and the contact member when the temperature rises and thermal expansion occurs according to an illustrative embodiment of the present invention.

In FIG. 9B, the contact member 202' having a V-shaped groove forming an angle of 120 degrees is illustrated as an example. Alternatively, the angle of the V-shaped groove may be adjusted according to the amount of expansion necessary. Still alternatively, as illustrated in FIG. 10, the shape of the groove of a contact member 202" may be a shape in which only portions that contact corners or edges of the bottom surface side of the positioning member 105 are made as inclined surfaces, or may be a shape in which inclined surfaces having a plurality of inclination angles are formed instead of the respective inclined surfaces of the V-shape.

Figures 11A, 11B:
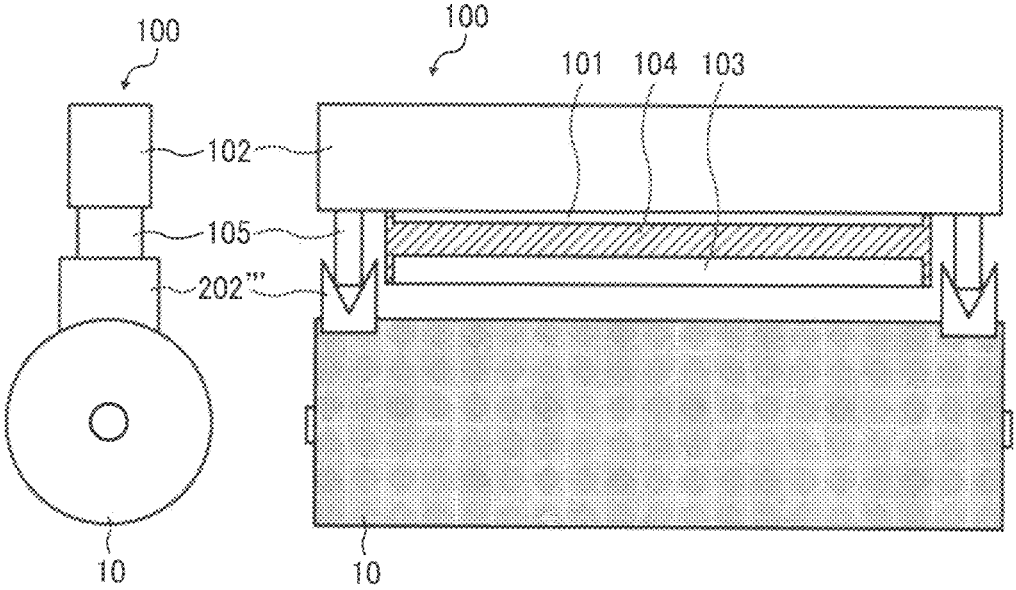
FIGS. 11A and 11B are schematic diagrams illustrating a variation of the second embodiment of the image forming apparatus according to an illustrative embodiment of the present invention.

Further, as illustrated in FIG. 11, the direction in which the groove of a contact member 202'" is formed may be not only a short side direction of the light emitting device array 101 as shown in FIG. 8 but also the longitudinal direction (the direction perpendicular to the direction in which a light beam is emitted from the light source).

In other words, any of the contact members 202', 202", 202'" includes a groove for supporting the positioning member by contacting the corners or edges of the bottom surface side of the positioning member 105, and preferably includes a groove that becomes gradually narrower in the direction in which a light beam is emitted from the light source device.

In this mechanism for adjusting (setting off) the position with the use of the groove of the contact member, the position of the positioning member 105 is desirably changed one-dimensionally (in one direction, the height direction) with respect to the amount of heat (application of heat due to a rise in the temperature). Accordingly, the grooves of the contact members 202', 202", 202'" desirably have a V shape that contacts two points of corners or edges of the bottom surface side of the positioning member in the cross section, or desirably has a shape having two inclined surfaces having a predetermined inclination angle.

In the present embodiment, a positional displacement of the focus can be adjusted by selecting the positioning member 105 having a linear expansion coefficient greater than that of the optical device holding member 104. More specifically, in a case where k2 represents the linear expansion coefficient of the positioning member 105, and k3 represents the linear expansion coefficient of the optical device holding member 104, selecting material that satisfies the relationship of k3≤k2 can compensate the above-described difference in the amount of thermal expansion.

It is desirable that the contact members 202', 202", 202'" be made of material which deforms little (i.e., material having a small linear expansion coefficient and a small Young's modulus) under environmental variations in temperature and stress in view of sliding property, abrasion property, and thermal deformation property with respect to the photoreceptor 10. Therefore, when material having a relatively larger linear expansion coefficient than that of the contact members 202', 202", 202'" is selected as the positioning member 105, both of the focus correction mechanism using the thermal variation and the contact members 202', 202", 202'" having a long lifespan can be achieved at the same time.

More specifically, where the linear expansion coefficient of the contact members 202', 202", 202'" is k4, it is preferable to set the linear expansion coefficient k4 with respect to the linear expansion coefficient k2 of the positioning member 105 such that the relationship of k2>k4 is satisfied.

Further, in a case where the light source holding member 102 is constituted by a plurality of parts (102A, 102B), the positioning member 105 is desirably positioned in place with respect to the part 102A supporting the light emitting device array 101. In this configuration, even when the light source holding part 102B deforms due to stress and the like, the photoreceptor 10 is positioned with respect to the light source holding part 102A on which the light emitting device array 101 is positioned. Therefore, the focus can be adjusted in response to thermal deformation.

In the present embodiment, the light source holding member 102 is made of material (metal) having high thermal conductivity such as aluminum. Accordingly, the temperature of a portion in which the light source holding member 102 and the light emitting device array 101 contact each other and the temperature of a portion in which the light source holding member 102 and the positioning member 105 contact each other can be made uniform. As a result, each of the positioning member 105 and the optical device holding member 104 can have a desired amount of thermal expansion, which makes this structure effective.

According to one aspect of the invention, the exposure device can cancel out a positional displacement of the focus caused by environmental variations and heat generated by the exposure device itself when the light emitting device array is activated, and can reduce, if not prevented entirely, deterioration of images. The object and the image surface are in a conjugate relationship with respect to the imaging device array (rod lens array). Accordingly, when the position of the object moves by $\Delta L1$ due to a thermal variation, the position of the image surface moves by $\Delta L1$ in a direction opposite the direction in which the object moves.

Therefore, as a whole, the focal position moves by $2\Delta L1$ from the initial state (FIG. 6). At this time, if the positioning member expands by $2\Delta L1$ due to heat, the focus can be maintained. However, in general, it is physically difficult to arrange a positioning member between the light emitting device array and the image bearing member only for expansion by $2\Delta L1$ (it may be possible to employ a material having a large linear expansion coefficient. In such case, however, the Young's modulus may decrease, and the positioning member may fail to perform properly). By employing this structure, a desired amount of heat variation can be generated in the positioning member, thereby maintaining the focal position.

According to one aspect of the present invention, the positioning member has a linear expansion coefficient greater than the light source holding member ($k1<k2$), and the thermal expansion of positioning member is greater than the thermal expansion of the light source holding member. Accordingly, the exposure device can cancel out a positional displacement of the focus caused by environmental variations and heat generated by the exposure device itself when the light emitting device array is activated, thus reducing, if not preventing entirely, deterioration of images.

According to one aspect of the present invention, a positioning member having the same or greater linear expansion coefficient than the optical device holding member is selected ($k3\leq k2$), and the amount of thermal expansion of the positioning member is made the same as the amount of positional displacement of the focus due to the amount of thermal expansion of the imaging device array. Accordingly, the exposure device can maintain the focus on the image bearing member in spite of environmental variations and heat generated by the exposure device itself when the light emitting device array is activated, thus reducing, if not preventing entirely deterioration of images.

According to one aspect of the present invention, the length of the positioning member is made longer than the distance between the light emitting device array and the imaging device array ($L2>L1$), and the amount of thermal expansion of the positioning member is made the same as the amount of positional displacement of the focus due to the amount of thermal expansion of the imaging device array. Accordingly, the exposure device can maintain the focus on the image bearing member in spite of environmental variations and heat generated by the exposure device itself when the light emitting device array is activated, and can suppress deterioration of images.

According to one aspect of the present invention, when the light source holding member for holding the light source device is constituted by a plurality of parts, the positioning member directly supports the parts holding the light source device. Accordingly, the exposure device provides higher accuracy in the position of the focus of the light source, and improves the quality of images.

According to one aspect of the present invention, the light source holding member is made of material having high thermal conductivity such as metal. With this configuration, the temperature of a portion of the light source holding member in contact with the light emitting device array (source of heat generation) and the temperature of a portion of the light source holding member in contact with the positioning member can be made uniform. When the temperatures are made uniform, each of the positioning member and the optical device holding member has a desired amount of thermal expansion.

According to one aspect of the present invention, the exposure device can cancel out a positional displacement of the focus caused by environmental variations and heat generated by the exposure device itself when the light emitting device array is activated, thus reducing, if not preventing entirely deterioration of images (see FIG. 6).

In the equation (1), the amount of positional displacement of the focus can be corrected by increasing the amount of thermal expansion of the positioning member or increasing the amount of thermal expansion of the abutment member. However, the contact member is desirably made of material which deforms little (i.e., material having a small linear expansion coefficient and a small Young's modulus) against environmental variations such as temperature and stress in view of sliding property, abrasion property, and thermal deformation property with respect to the image bearing member (photosensitive member).

According to one aspect of the present invention, material having a relatively larger linear expansion coefficient than the contact member is selected as the positioning member. Accordingly, both of the thermal variation property and a long lifespan of the contact member can be achieved at the same time.

According to one aspect of the present invention, even when the length L2 of the positioning member (in the direction light projection from the light source device) cannot have a desired length, a desired amount of thermal expansion can be ensured by making the portion of the contact member contacting the positioning member into a predetermined shape. Further, the contact member has a groove that becomes gradually narrower in the direction of light projection from the light source device. Accordingly, when the positioning member expands due to heat, the contact area of the positioning member increases, and the position of the positioning member contacting the contact member shifts in the direction opposite to the direction of light projection. In addition, the distance between the light emitting device array and the image bearing member increases. Therefore, the exposure device can cancel out a positional displacement of the focus caused by environmental variations and heat generated by the exposure device itself when the light emitting device array is activated, thus reducing, if not preventing entirely, deterioration of images.

According to one aspect of the present invention, the walls of the groove of the contact member are two inclined surfaces in a V shape or having a predetermined inclination angle. Accordingly, the groove serves as a positional adjustment (cancelling) mechanism to change one-dimensionally with respect to the amount of heat. Therefore, the exposure device can cancel out a positional displacement of the focus caused by environmental variations and heat generated by the exposure device itself when the light emitting device array is activated, thus reducing, if not preventing entirely, deterioration of images.

According to one aspect of the present invention, regarding the amount of positional displacement of the focus that cannot be corrected, the width of adjustment can be increased by selecting a positioning member having a high linear expansion coefficient than the optical device holding member. Further, the exposure device can cancel out a positional displacement of the focus caused by environmental variations and heat generated by the exposure device itself when the light emitting device array is activated, thereby reducing, if not preventing entirely, deterioration of images.

According to the illustrative embodiment, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An exposure device comprising:

a light source device including a plurality of light emitting devices arrayed in a one-dimensional or a two-dimensional array, to project light;

a light source holding member to hold the light source device in place, the light source holding member being made of metal;

an optical device to focus the light projected from the light source device onto an image bearing member;

an optical device holding member to hold the optical device so as to maintain a predetermined gap between the optical device and the light source device on the light source holding member;

a positioning member fixed to a side of the light source holding member in a longitudinal direction of the light source holding member to support the light source holding member above the image bearing member so as to maintain a predetermined gap between the image bearing member and the light source device on the light source holding member, the position at which the positioning member supports the light source holding member being behind a light projection point of the light source device in a direction opposite the image bearing member; and a contact member that separates the positioning member and the image bearing member, wherein the following relation is satisfied:

$$k1<k2$$

where k1 is a linear expansion coefficient of the light source holding member and k2 is a linear expansion coefficient of the positioning member.

2. The exposure device according to claim 1, wherein the following relation is satisfied:

$$k3\leq k2,$$

where k3 is a linear expansion coefficient of the optical device holding member.

3. The exposure device according to claim 1, wherein the relation of L2>L1 is satisfied, where L1 is a distance between a surface of the light source device from which the light is projected and a surface of the optical device upon which the light incidents, and L2 is a distance between a position at which the positioning member supports the light source holding member and a top of the contact member.

4. The exposure device according to claim 1, wherein the light source holding member is constituted by a single part or a plurality of parts, and the positioning member directly supports at least one of the plurality of parts that holds the light source device.

5. The exposure device according to claim 1, wherein the metal is aluminum.

6. The exposure device according to claim 1, wherein the positioning member adjusts a focus of the light projected from the light source device onto the image bearing member based on an amount of thermal expansion of the positioning member.

7. The exposure device according to claim 1, wherein a distance between the optical device and the image bearing member increases when a temperature of an atmosphere in the exposure device increases.

8. The exposure device according to claim 1, wherein the positioning member is fixed to the side of the light source holding member at only one position along the positioning member in a direction perpendicular to the image bearing member.

9. The exposure device according to claim 1, wherein a length of the positioning member is greater than a distance between the plurality of light emitting devices arrayed and a rod lens array of the optical device.

10. An image forming apparatus, comprising:

an image bearing member to bear an electrostatic latent image;

an exposure device that includes:

a light source device including a plurality of light emitting devices arrayed in a one-dimensional or a two-dimensional array, to project light, a light source holding member to hold the light source device in place, an optical device to focus the light projected from the light source device onto an image bearing member, an optical device holding member to hold the optical device so as to maintain a predetermined gap between the optical device and the light source device on the light source holding member, and a positioning member to support the light source holding member above the image bearing member so as to maintain a predetermined gap between the image bearing member and the light source device on the light source holding member, the position at which the positioning member supports the light source holding member being opposite the image bearing member when seen from the light projection point of the light source device; and a contact member disposed continuously to the positioning member of the exposure device, to contact the image bearing member, wherein the relation of $L2\cdot k2+L5\cdot k4=2L1\cdot k3+L4\cdot k1$ is satisfied, where k1 is a linear expansion coefficient of the light source holding member, k2 is a linear expansion coefficient of the positioning member, k3 is a linear expansion coefficient of the optical device holding member, k4 is a linear expansion coefficient of the contact member, L1 is a distance between a surface of the light source device from which a light beam is emitted and a surface of the optical device into which the light bean enters, L2 is a distance between a position at which the positioning member supports the light source holding member and a top of the contact member, L4 is a distance between a position at which the light source holding member contacts the light source device and a position at which the light source holding member is supported by the positioning member, and L5 is a distance between a position at which the contact member contacts the positioning member and a position at which the contact member contacts the image bearing member.

11. The image forming apparatus according to claim 10, wherein the relation of k2>k4 is satisfied.

* * * * *